US006500054B1

(12) United States Patent
Ma et al.

(10) Patent No.: US 6,500,054 B1
(45) Date of Patent: Dec. 31, 2002

(54) CHEMICAL-MECHANICAL POLISHING PAD CONDITIONER

(75) Inventors: William H. Ma, Fishkill, NY (US); Adam D. Ticknor, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/590,576

(22) Filed: Jun. 8, 2000

(51) Int. Cl.[7] ..... B24B 1/00
(52) U.S. Cl. ..... 451/56; 451/443; 451/529
(58) Field of Search ..... 451/56, 72, 443, 451/444, 526, 527, 529, 296, 41

(56) References Cited

U.S. PATENT DOCUMENTS

| | | | | |
|---|---|---|---|---|
| 5,081,796 A | | 1/1992 | Schultz | |
| 5,216,843 A | | 6/1993 | Breivogel et al. | |
| 5,222,329 A | | 6/1993 | Yu | |
| 5,297,364 A | * | 3/1994 | Tuttle | 51/209 R |
| 5,461,007 A | | 10/1995 | Kobayashi | |
| 5,527,424 A | | 6/1996 | Mullins | |
| 5,547,417 A | | 8/1996 | Breivogel et al. | |
| 5,611,943 A | | 3/1997 | Cadien et al. | |
| 5,664,987 A | | 9/1997 | Renteln | |
| 5,785,585 A | | 7/1998 | Manfredi et al. | |
| 5,801,066 A | | 9/1998 | Meikle | |
| 5,851,138 A | | 12/1998 | Hempel, Jr. | |
| 5,941,762 A | | 8/1999 | Ravkin et al. | |
| 5,984,769 A | * | 11/1999 | Bennett et al. | 451/527 |
| 6,027,659 A | | 2/2000 | Billett | |
| 6,045,434 A | | 4/2000 | Fisher, Jr. et al. | |
| 6,165,904 A | * | 12/2000 | Kim | 438/692 |
| 6,213,856 B1 | * | 4/2001 | Cho et al. | 451/443 |
| 6,261,168 B1 | * | 7/2001 | Jensen et al. | 451/527 |
| 6,328,632 B1 | * | 12/2001 | Chopra | 451/41 |

* cited by examiner

*Primary Examiner*—Timothy V. Eley
*Assistant Examiner*—Dung Van Nguyen

(57) ABSTRACT

A chemical-mechanical polishing (CMP) pad conditioner. The conditioner has a non-uniform conditioning surface with a plurality of conditioning elements. The non-uniform surface comprises a first section having a first cutting volume per unit width and a second section having a second cutting volume per unit width that is different from the first cutting volume per unit width. The difference in cutting volume may be provided by different projected widths of the individual conditioning elements, by a difference in the linear density between the two sections, or by a difference in the cutting depth. A CMP tool comprising a polishing pad, a conditioning pad having the disclosed structure, and a mechanism for moving the polishing pad relative to the pad conditioner is also provided. A method is further provided for uniformly conditioning a CMP pad using a conditioner having the structure described.

31 Claims, 3 Drawing Sheets

CHEMICAL-MECHANICAL POLISHING PAD CONDITIONER

TECHNICAL FIELD

The present invention relates generally to semiconductor manufacturing and, more specifically, to the conditioning of polishing pads used for chemical-mechanical polishing (CMP).

BACKGROUND OF THE INVENTION

Chemical-Mechanical Polishing (CMP) is a key processing technology for fabricating semiconductor chips. Often, after the performance of a processing step, the resulting wafer surface is full of peaks and valleys. Peaks and valleys of subsequent processing steps can build upon one another, creating an uneven surface that may be undesirable for a number of reasons. CMP uses a polishing pad and a slurry of chemically active liquid and abrasive material to grind down the surface of a wafer, thus restoring the planar surface.

In particular, CMP is useful for planarizing intermetal dielectric layers of silicon dioxide or for removing portions of conductive layers within integrated circuit devices. Non-planar dielectric surfaces may interfere with the optical resolution of subsequent photolithography processing steps, making it extremely difficult to print high-resolution lines. The application of a second metal layer over an intermetal dielectric layer having large step heights can result in inadequate metal coverage, and ultimately in an open circuit.

FIG. 1 illustrates an exemplary linear CMP process. A semiconductor wafer 20 is typically held face down against a flat polishing pad 22 that has been coated with the slurry (not shown) and that moves relative to wafer 20 along arrow A. A rectangular conditioning pad 26 is used to condition polishing pad 22 continuously as wafer 20 is polished.

In an exemplary rotary CMP process, shown in FIG. 2, semiconductor wafer 20 is typically held face down and rotated along arrow C against a flat polishing pad 24 that has been coated with the slurry and that rotates along arrow B. Both wafer 20 and pad 24 are typically rotated relative to each other. Also shown in FIG. 2 are a first reference location 32 on polishing pad 24 and a second reference location 30 on polishing pad 24 located radially inward of location 32. As for the linear CMP process, rectangular conditioning pad 26 is used to condition polishing pad 24 continuously as wafer 20 is polished in the rotary CMP process. In both the linear and rotary CMP processes, the abrasive polishing process continues until the surface of wafer 20 contacting polishing pad 22 or 24 is substantially planar.

The motion of wafer 20 with respect to polishing pad 22, 24 and the force applied to hold wafer 20 against the pad adds mechanical energy to the system that helps remove the wafer surface material. In addition, the process of supplying fresh chemical liquid and removing spent chemical liquid helps remove material from the wafer surface. Uniform removal of material from the surface of wafer 20 is pursued by adjusting a number of variables, such as the pad velocity with respect to the wafer surface, the force applied between the pad and the wafer, and the slurry composition and flow.

Over time, the initially rough surface of polishing pad 22, 24 becomes worn and may glaze over due to a build-up of slurry and other deposits on the pad surface. To counteract the glazing and wear, polishing pad 22, 24 is periodically mechanically scored or "conditioned." Conditioning pad 26 removes the build-up on polishing pad 22, 24 and roughens the surface of polishing pad 22, 24. Different approaches to conditioning may be required depending on the hardness of the pad surface and the particular slurry used for polishing. Further, conditioning may be performed by a conditioning apparatus in a discrete conditioning step or during wafer polishing depending on the specific conditioning process and apparatus used. FIGS. 1 and 2 both show rectangular conditioning pad 26 that may be used to condition polishing pad 22, 24 continuously as wafer 20 is polished.

The polishing pad-and-slurry combination may be envisioned as a piece of sandpaper in which the slurry acts as the sand and the polishing pad acts as the paper on which the sand is mounted. The slurry may have different particle sizes, with larger particles providing more grinding of the wafer surface than smaller particles, similar to the difference between larger and smaller grit sandpaper. The more slurry held against the wafer surface or greater particle size of the slurry, the more grinding that may occur. Grooves in polishing pad 22, 24 drain the slurry away from the surface of the pad. Slurry in the grooves is thus ineffective or less effective at grinding than slurry on the surface of the pad.

The shape and volume of the grooves per unit area of polishing pad 22, 24 therefore control to some degree the amount of polishing. For example, larger grooves not only take more slurry away from the surface, but also may completely or partially trap larger particles. Small grooves that are unable to trap large slurry particles leave the large particles in contact with wafer 20, providing more grinding than parts of polishing pad 22, 24 where the grooves are large enough to allow such particles to be trapped in the grooves. Intermediate size grooves may only partially trap the particles, leaving portions of the large particles protruding and providing less polishing than where only small grooves are present, but more so than where large grooves are present. The depth of the grooves may further control how much of the slurry is drained away, deeper grooves providing areas with less polishing capability than in shallower grooves.

Thus, the polishing rate and uniformity of the CMP process may be greatly affected by the characteristics of the polishing pad surface, which can make the slurry more or less effective. The ability to optimize the pad surface during conditioning is therefore highly desirable.

SUMMARY OF THE INVENTION

The present invention provides a chemical-mechanical polishing pad conditioner comprising a non-uniform conditioning surface having a plurality of conditioning elements and at least a first section and a second section. The first section has a first cutting volume per unit width that is greater than the second cutting volume per unit width of the second section. The first section may include at least one first conditioning element having a first projected width whereas the second section includes at least one second conditioning element having a second projected width that differs from the first projected width. The first section may also or instead have a first plurality of conditioning elements with a first density whereas the second section has a second plurality of conditioning elements with a second density that is different from the first density. The first section may also or instead have at least one conditioning element with a first cutting depth whereas the second section has at least one conditioning element with a second cutting depth different from the first depth.

The conditioner may be adapted for use in a linear or rotary CMP operation, and may be rectangular or may be a roller-type conditioner. In a rotary application, the non-uniform conditioning surface may be designed to compensate for a difference in relative velocity of the polishing pad at a radial-inward location as compared to a radial-outward location.

The conditioner may further comprise a third, transition section between the first section and the second section. The third section has a third cutting volume per unit width intermediate the first and second cutting volumes per unit width. The third section also has a gradual transition in cutting volume per unit width between the first and second cutting volumes per unit width.

The conditioner may be an element in a chemical-mechanical polishing tool comprising a polishing pad, the conditioner, and a mechanism for moving the polishing pad relative to the conditioner. The mechanism may further be adapted to move the polishing pad relative to the conditioner in a linear or rotary manner.

The conditioner may be used to perform a method for providing uniform conditioning of a chemical-mechanical polishing pad. The method first comprises the step of identifying at least a first region of the polishing pad that requires a different volume of material removed by the conditioner than a second region of the polishing pad. Then, the conditioner is provided with a non-uniform conditioning surface having a first section with a first cutting volume per unit width positioned to contact the first region of the polishing pad and a second section with a second cutting volume per unit width positioned to contact the second region of the polishing pad. The conditioner is then used to condition the polishing pad.

The invention also comprises a chemical-mechanical polishing pad that results from use of the conditioner of this invention. Such a pad comprises a non-uniform polishing surface having a plurality of grooves and at least a first region and a second region. The first region has a first groove volume per unit area that differs from a second groove volume per unit area of the second region.

It is to be understood that both the foregoing general description and the following detailed description are exemplary, but are not restrictive, of the invention.

BRIEF DESCRIPTION OF DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF INVENTION

Figure 3:
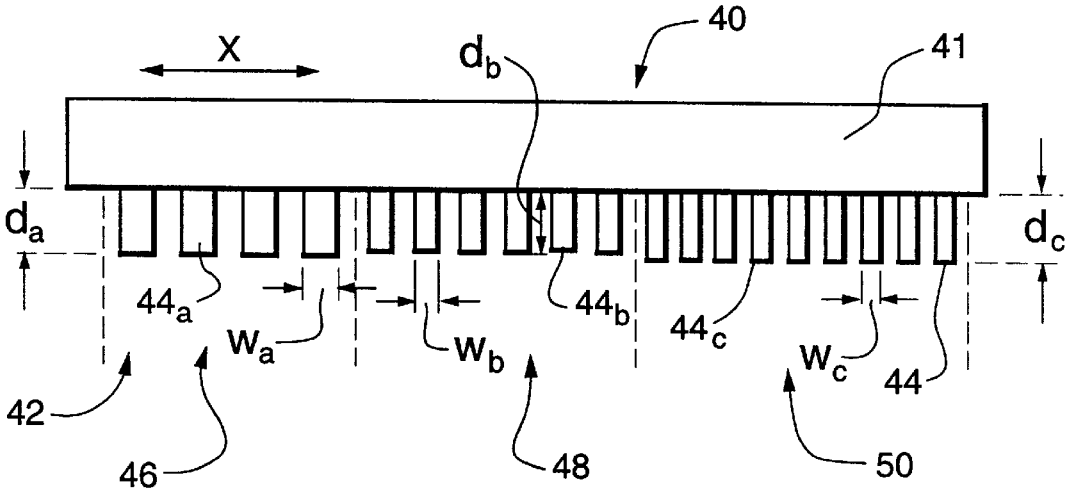
FIG. 3 depicts a side view of an exemplary rectangular pad conditioner of the present invention.

Referring now to the drawing, in which like reference numbers refer to like elements throughout, FIG. 3 depicts an exemplary chemical-mechanical polishing pad conditioner 40 having a non-uniform conditioning surface 42 comprising a plurality of conditioning elements 44. Non-uniform surface 42 comprises three distinct sections 46, 48, and 50. Conditioning elements 44*a* in section 46 have a width $w_a$ that is greater than the width $w_c$, of conditioning elements 44*c* in section 50. Conditioning elements 44*b* in section 48 have a width $w_b$ that is intermediate widths $w_a$ and $w_c$.

Figure 5:
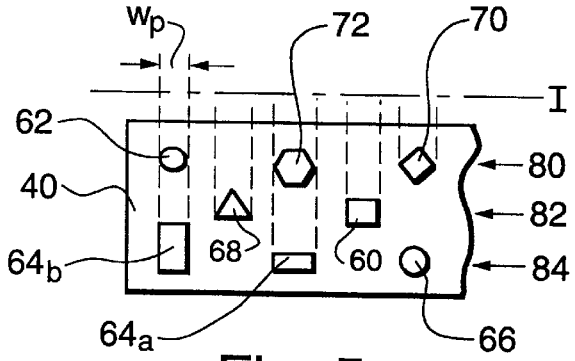
FIG. 5 depicts a plan view of an exemplary conditioner showing various geometries for conditioning elements with equivalent projected widths.

The conditioning elements may have any cross-sectional geometry known in the art, as shown in FIG. 5, including but not limited to: a square 60; an ellipse or oval 62; a rectangle 64*a*, 64*b* with the longer side facing the cutting plane (64*a*) or the shorter side facing the cutting plane (64*b*); a circle 66; a triangle 68, a diamond 70; or any type of polygon 72. Every cross-sectional geometry has a "projected width," however, onto imaginary plane I. This projected width is essentially what is seen from a side view of the conditioner 40, such as is shown in FIG. 3. Thus, as shown in FIG. 5, each of the conditioning elements, despite its different cross-sectional geometry, may have the same projected width $w_p$.

Certain cross-sectional geometries may be preferred for strength of the element or for cutting ability. For example, diamond-shaped or triangular cross-sections with a corner facing the plane I may be ideal for providing optimal cutting. Although conditioner 40 is shown for illustrative purposes in FIG. 5 with a plurality of different shaped studs, typically a conditioner will contain only a single type of stud. Multiple shapes may be used on a single conditioner, however, if desired.

The group of conditioning elements 44*c* in section 50 can also be said to have a density that is greater than the group of elements 44*a* in section 46. "Density" refers to the number of projected elements per unit width. A unit width is measured along arrow X in the cross section of FIG. 3. Although only a single row of elements appears to be visible in the side view of FIG. 3, conditioner 40 may have several rows of elements as shown in FIG. 5 from an underside view. The elements of each row may directly align with the elements of the other rows as viewed from plane I, such as the elements in the rows 80 and 84, or the elements of one row may fill the gaps between elements of another row, as the elements of row 82 fill in the gaps in rows 80 and 84. The number of "projected elements" is the number of elements that are visible from a side view. Thus, as shown in FIG. 5, there are five projected elements, although three of the elements are aligned in rows 80 and 84 and two of the elements are in row 82.

The conditioning elements 44*c* in section 50 are shown with a greater cutting depth than the cutting depth of elements 44*a*."Cutting depth" refers to the depth that the conditioning element penetrates the polishing pad. The degree to which each element penetrates the polishing pad is controlled by the amount of pressure exerted on the conditioning pad as it contacts the polishing pad. Generally, however, elements that protrude a longer distance from conditioner body 41 have a longer cutting depth. Thus, elements 44*c* that protrude a depth of $d_c$, have a longer cutting depth than elements 44*a* that protrude a depth $d_a$ from body 41. Elements 44*b* that protrude a depth $d_b$ have an intermediate cutting depth between the cutting depths $d_a$ and $d_c$ of elements 44*a* and 44*c*, respectively.

The differences in depth, density, and projected width per conditioning element, or some combination of those geometric features, provide each region with a different cutting volume per unit width. The term "cutting volume per unit width" relates to the volume of the polishing pad that is removed by the conditioner per each unit width of the conditioner. For example, in FIG. 3, where each conditioning element 44 comprises a stud that protrudes from body 41 of conditioning pad 40, the cutting volume per unit width equals the total number of studs projected onto a single row times the projected width of each stud times the cutting depth of each stud, divided by the length of the region.

In some embodiments, a combination of larger element projected width, greater density, and greater cutting depth may be used to provide the greater cutting volume per unit width. In other embodiments, a differential in only one such feature may be used to provide the different cutting volume per unit width. In some embodiments, a larger element projected width may be offset by a lesser density, or a greater density may be offset by a lesser element projected width.

Chemical-mechanical polishing pad conditioners of the present invention may be designed for use with either linear CMP operations or rotary CMP operations. When used with a rotary CMP operation, the non-uniformity may be designed to compensate for a difference in relative velocity between the polishing pad and the wafer at a radial inward location as compared to a radial outward location. For example, referring now to FIG. 2, location 30 on polishing pad 24 is located radially inward of location 32. The relative velocity between polishing pad 24 and wafer 20 at outward location 32 is greater than at inward location 30. As a result, the grinding action at location 32 of polishing pad 24 may be greater than at location 30.

To address this non-uniformity in the velocity, it may be desirable to provide a groove structure on the surface of polishing pad 24 so that there is more slurry volume removed,from the surface of the pad at location 32 than at location 30. To provide such difference in pad groove structure, it may be desirable to provide conditioner 40 with a greater cutting volume per unit width in the section of conditioner 40 that conditions location 32 of polishing pad 24 than in the section of conditioner 40 that conditions location 30. As shown in FIG. 3, conditioner 40 provides such a configuration if section 50 is aligned with location 30 and section 46 is aligned with location 32. It may be further desirable for section 48 to comprise a gradual transition between sections 50 and 46, or for there to be a continuum between a smallest conditioning element 44*c* at an inner location and a largest conditioning element 44*a* at a radial outward location.

In general, the non-uniformity in conditioner 40 may be tailored to compensate for a non-uniformity in polishing pad wear or tool application pressure. For example, in a linear CMP operation, the wear of the polishing pad may be different or the pressure applied between the pad and the wafer may be different at the edges than in the center. Thus, a different cutting volume per unit width may be needed on the edges than in the center to keep the polishing action of the pad uniform.

Figure 4:
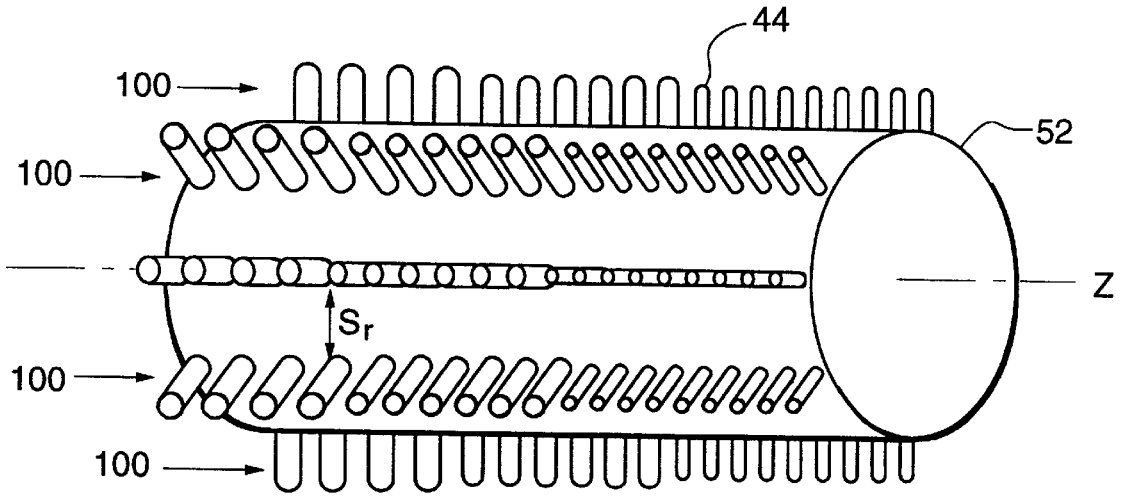
FIG. 4 depicts a perspective view of an exemplary cylindrical roller pad conditioner of the present invention.

Although FIG. 3 depicts conditioner 40 having a rectangular shape, the shape may be any shape as is known in the art. In one embodiment, the conditioner may be a cylindrical roller-type conditioner 52 that is adapted to be rotated about an axis Z, as shown in FIG. 4. Such a conditioner may be used with linear or rotary CMP operations and is positioned similar to a rectangular conditioner. The cylindrical roller shape allows the roller to be rotated about axis Z, however, to increase or decrease the relative velocity between the polishing pad and the conditioner. Roller-type conditioner 52 may be mounted on a shaft (not shown) coaxial with axis Z, which may be rotated any mechanism known in the art for rotating a shaft.

Figure 1:
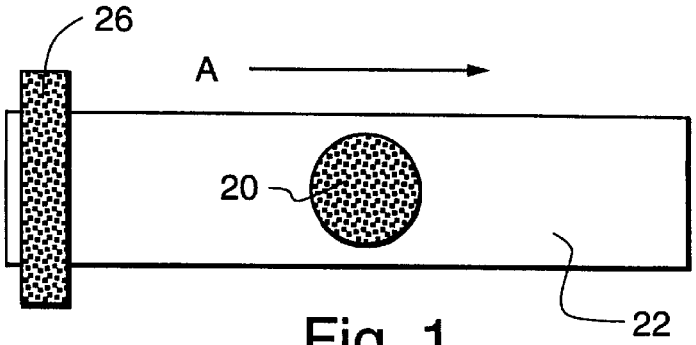
Fig. 1 (PRIOR ART)
FIG. 1 depicts a plan view of a typical linear CMP operation.
Figure 2:
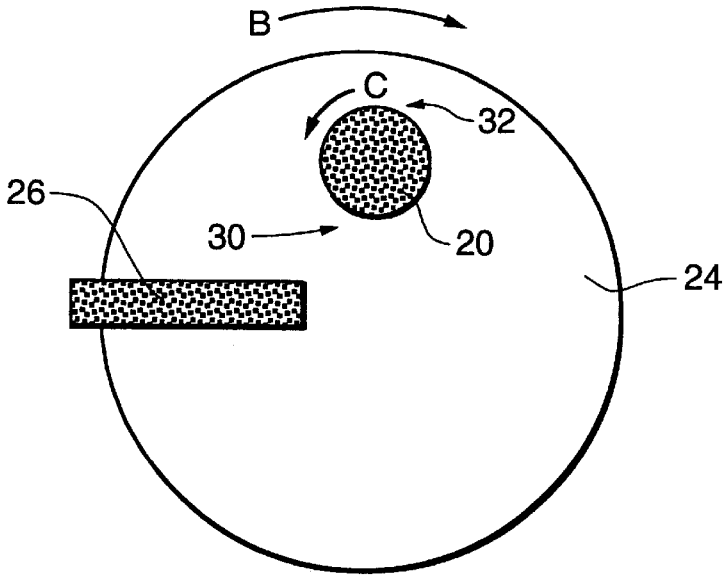
Fig. 2 (PRIOR ART)
FIG. 2 depicts a plan view of a typical rotary CMP operation.

The depicted conditioners may be used with any chemical-mechanical polishing tools known in the art, such as are depicted in FIGS. 1 and 2, but are not limited to such configurations. Any tool having a polishing pad and a mechanism for moving the polishing pad relative to the pad conditioner may be used with the conditioning pad structures illustrated and described. Tools for use with cylindrical roller conditioning pads, such as shown in FIG. 4, further include structure for revolving the conditioning pad about axis Z, as is known in the art.

Thus, the depicted conditioners may be used to condition a chemical-mechanical polishing pad. The method of providing such conditioning comprises identifying at least a first region of the polishing pad that requires a different groove volume per unit area than a second region of the polishing pad. For example, a first region may require wider or deeper grooves than a second region of the polishing pad. In rotary CMP operations, the different velocities at radial inner and outer locations on the pad necessitate a different groove volume per unit area in inner and outer sections of the polishing pad.

Next, the method comprises constructing a conditioner with a non-uniform conditioning surface having a first section tailored with a first cutting volume per unit width aligned with the first region of the polishing pad and a second section tailored with a second cutting volume per unit width aligned with the second region, in accordance with the structures described above. In the example for which more extensive conditioning is needed in one region versus another, the conditioning pad is such that a first section is tailored to condition the first region of the polishing pad more than a second section conditions the second region. The conditioner so provided is then used to condition the polishing pad.

The scope of the present invention embodies conditioners comprising any materials of construction known in the art, conditioners having conditioning elements of any size and cross-sectional geometry, and conditioners having any density that is functional to provide the desired degree of conditioning.

Figure 6:
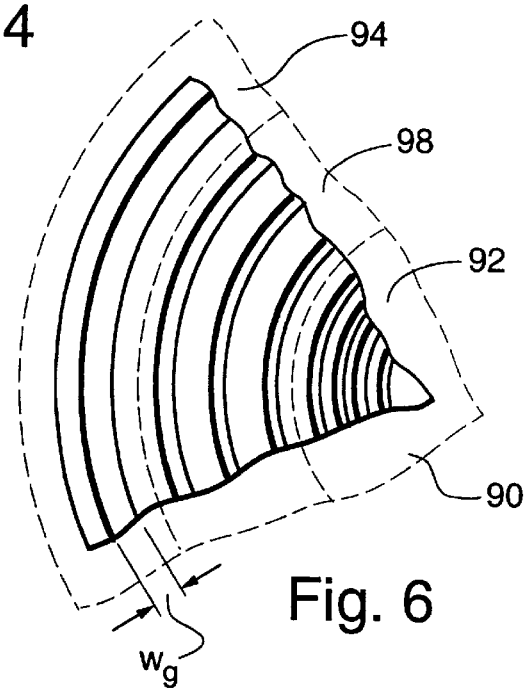
FIG. 6 depicts a plan view of a portion of a rotary polishing pad created by use of the conditioner of the present invention.

Referring now to FIG. 6, the pie-shaped portion of rotary polishing pad 90 conditioned with a conditioner as described above may have a corresponding groove volume per unit area in one region that is different than in another. For example, as shown in FIG. 6, the region 92 has a greater density of grooves than the region 94. Region 94 has a greater groove width $w_g$ than region 92. The groove depth $d_g$ may also be varied in accordance with the cutting depth of the conditioning elements, as illustrated in the linear polishing pad 96 depicted in FIG. 7, showing grooves 93 a depth $d_{g1}$ that is greater than the depth $d_{g2}$ of the grooves 95.

As with the conditioner used to condition the polishing pad, the polishing pad may comprise two regions 92 and 94 having a different groove volume per unit area, and may further comprise a third region 98 between regions 92 and 94 having an intermediate groove volume per unit area. The third region may provide a gradual transition from the first and second regions. Although described as created by use of a conditioner of the present invention, polishing pads having the above structural characteristics may be provided with such characteristics before any conditioning or polishing. Such polishing pads may be manufactured by any processes known in the art.

Figure 8:
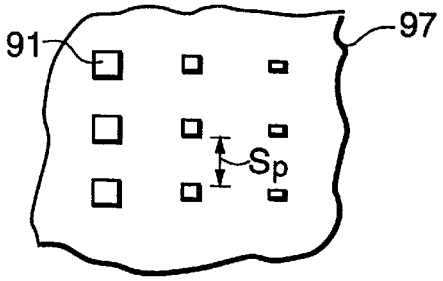
FIG. 8 depicts a plan view of a portion of a polishing pad created by use of a roller-type conditioner of the present invention for which the conditioner and polishing pad are traveling at approximately the same speed.
Figure 7:
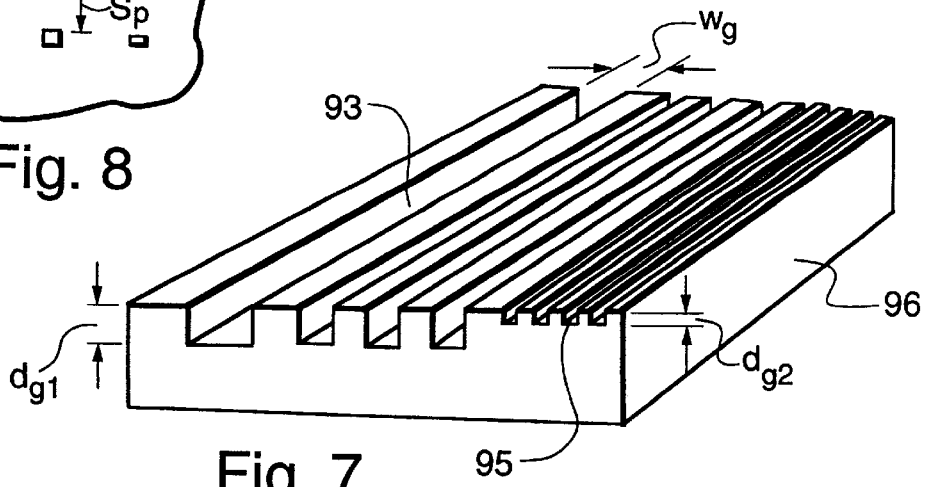
FIG. 7 depicts a partial cross-section perspective view of a portion of a linear polishing pad created by use of a conditioner of the present invention.
Figure 9:
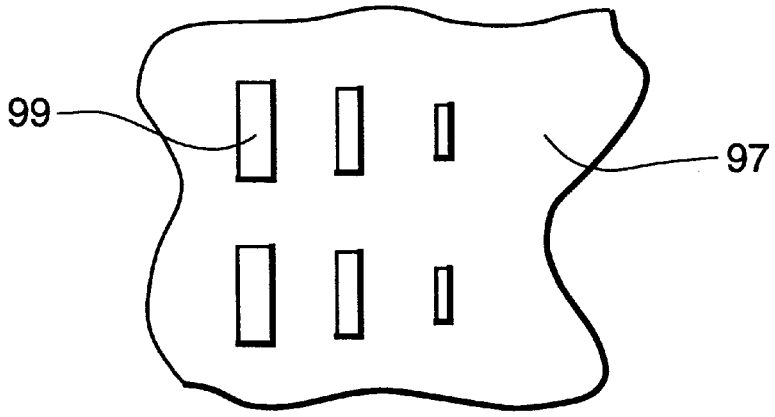
FIG. 9 depicts a plan view of a portion of a polishing pad created by use of a roller-type conditioner of the present invention for which the conditioner is traveling at a speed slower than the conditioning pad.

Although shown in FIGS. 6 and 7 with continuous elongated grooves, a polishing pad 97 conditioned with a roller-type conditioner 52 may have discontinuous, shorter grooves, such as grooves 91, as shown in FIG. 8, and grooves 99, as shown in FIG. 9. The length of each groove depends upon the speed of roller-type conditioner 52 relative to the speed of polishing pad 97 at the point of contact between the two surfaces. Roller-type conditioner 52 and polishing pad 97 moving at approximately the same speed results in discontinuous grooves 91 that are no longer than approximately conditioning elements 44 that create the grooves, as shown in FIG. 8. Roller-type conditioner 52 moving slower than polishing pad 97 results in elongated, discontinuous grooves 99. Roller-type conditioner 52 moving faster than polishing pad 97 results in elongated grooves with a space $s_p$ between discontinuous grooves that is shorter than the space $S_r$ between rows 100 of studs 44 on the surface of roller-type conditioner 52.

Although roller-type conditioner 52 shown in FIG. 4 comprises rows 100 of conditioning elements 44 parallel to axis Z that extend from one end of the roller to another, roller-type conditioners may have patterns of conditioning elements (e.g., studs) that are non-linear, that are different in one longitudinal section as compared to another, that have a different density in one section as compared to another, that do not extend from one end to another, or some combination of such arrangements, just as for non-roller-type conditioners as shown in FIG. 3. A roller-type conditioner has the additional parameter, however, of "row density"—the number of rows per circumference. Thus, one longitudinal section may have a greater row density than another section.

Roller-type conditioners may also have all of the other variations in conditioning element parameters as described relative to non-roller-type conditioners. The variations in row density from one section to another, as well as variations in conditioning element width and height or density per unit width provide different cutting volumes per unit width revolution of the roller. Thus, one revolution of one unit width in one section of the roller may cut a different volume of the conditioning pad than a unit width in another section of the roller.

Figure 10:
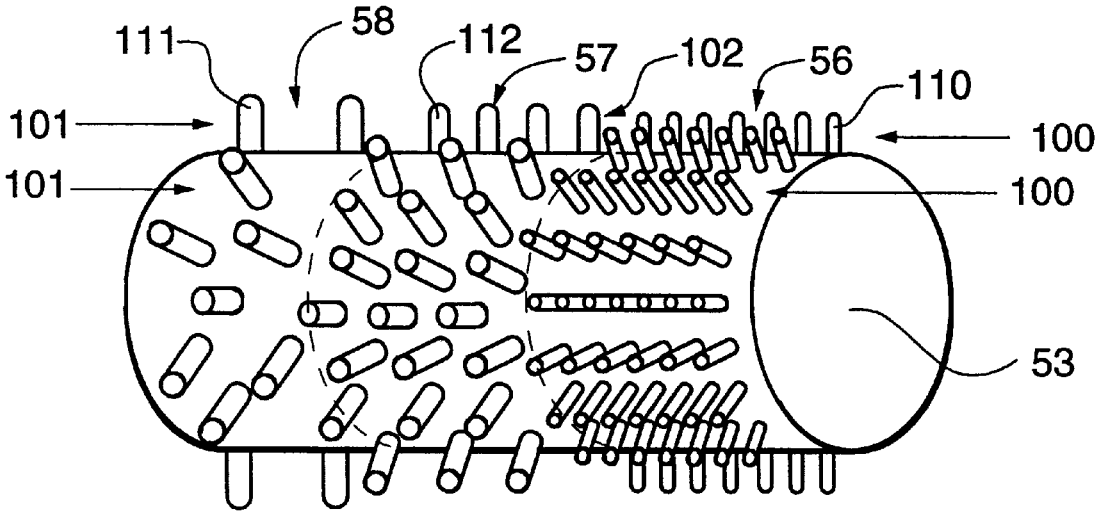
FIG. 10 depicts a perspective view of an exemplary cylindrical roller pad conditioner of the present invention showing sections having different row densities.

For example, roller 53 as shown in FIG. 10 has a first longitudinal section 56 that has nine rows 100 of studs 110 each having a first width and height per the half-circumference shown, whereas second section 58 has only seven rows 101 of studs 111 each having a second width and height per half-circumference. Where different sections exist, there may be any number of sections, or even no discrete separation between sections, but rather a gradual transition from one pattern at one end to a different pattern at the other end. As shown in FIG. 10, section 57 between sections 56 and 58 comprises a transitional section having eight rows 102 of studs 112 each having a third width and height intermediate the first and second width and height. Different patterns in one end of a roller-type conditioner versus the other end may be beneficial, for example, on a roller-type conditioner;for use with a rotary polishing pad. Such use may provide different patterns of studs to compensate for the different radial velocity at the inner radius of the pad compared to the outer radius of the pad.

Although illustrated and described above with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A conditioner for conditioning a chemical-mechanical polishing pad, the chemical-mechanical polishing pad conditioner comprising a non-uniform conditioning surface having a plurality of conditioning elements and at least a first section and a second section, the first section defining a first cutting volume per unit width that is different from a second cutting volume per unit width of the second section, the first section positioned to condition a first region of the polishing pad and the second section positioned to condition a second region of the polishing pad.

2. The chemical-mechanical polishing pad conditioner of claim 1 wherein the first section comprises at least a first conditioning element having a first projected width and the second section comprises at least a second conditioning element having a second projected width that is different from the first projected width.

3. The chemical-mechanical polishing pad conditioner of claim 1 wherein the first section comprises a first conditioning element density and the second section comprises a second conditioning element density different from the first conditioning element density.

4. The chemical-mechanical polishing pad conditioner of claim 1 wherein the first section comprises at least a first conditioning element having a first cutting depth and the second section comprises at least a second conditioning element having a second cutting depth that is different from the first cutting depth.

5. The chemical-mechanical polishing pad conditioner of claim 1 wherein the conditioning elements comprise studs.

6. The chemical-mechanical polishing pad conditioner of claim 5 wherein the studs have a cross-sectional geometry selected from the group consisting of a square, an oval, a rectangle, a circle, a triangle, an ellipse, a diamond, a polygon, and a combination of such geometries.

7. The chemical-mechanical polishing (CMP) pad conditioner of claim 1 wherein the conditioner is adapted for use in a linear CMP operation.

8. The chemical-mechanical polishing pad conditioner of claim 7 wherein the first section is positioned to condition a center region of the polishing pad and the second section is positioned to condition an edge region of the polishing pad.

9. The chemical-mechanical polishing pad conditioner of claim 1 wherein the conditioner is adapted for use in a rotary chemical-mechanical polishing operation.

10. The chemical-mechanical polishing pad conditioner of claim 9 wherein the first section is positioned to condition a center region of the polishing pad and the second section is positioned to condition an edge region of the polishing pad.

11. The chemical-mechanical polishing pad conditioner of claim 9 wherein the non-uniform conditioning surface compensates for a difference in velocity of the polishing pad at a radial inward location as compared to a radial outward location.

12. The chemical-mechanical polishing pad conditioner of claim 1 wherein the non-uniformity in the conditioner compensates for a non-uniformity in polishing pad wear or a non-uniformity in applied pressure of the polishing pad against a wafer during polishing.

13. The chemical-mechanical polishing pad conditioner of claim 1 wherein the conditioner has a rectangular shape.

14. The chemical-mechanical polishing pad conditioner of claim 1 wherein the conditioner comprises a cylindrical roller.

15. A conditioner for conditioning a chemical-mechanical polishing pad, the chemical-mechanical polishing pad conditioner comprising a non-uniform conditioning surface having a plurality of conditioning elements and at least a first section, a second section, and a third, transition section between the first section and the second section, the first section defining a first cutting volume per unit width that is different from a second cutting volume per unit width of the second section, and the third section comprising a third cutting volume per unit width intermediate the first cutting volume per unit width and second cutting volume per unit width.

16. The chemical-mechanical polishing pad conditioner of claim 15 wherein the third section comprises a gradual transition in cutting volume per unit width between the first cutting volume per unit width and the second cutting volume per unit width.

17. A chemical-mechanical polishing tool comprising:

a polishing pad, a conditioner including a non-uniform conditioning surface with a first section having a first cutting volume per unit width and a second section having a second cutting volume per unit width that is unequal to the first cutting volume per unit width, the first section positioned to condition a first region of the polishing pad and the second section positioned to condition a second region of the polishing pad; and means for moving the polishing pad relative to the conditioner.

18. The chemical-mechanical polishing tool of claim 17 wherein the means for moving the polishing pad relative to the conditioner does so in a linear manner.

19. The chemical-mechanical polishing tool of claim 17 wherein the means for moving the polishing pad relative to the conditioner rotates the polishing pad relative to the conditioner.

20. The chemical-mechanical polishing tool of claim 17 wherein the conditioner is a cylindrical roller having an axis and the tool further comprises means for revolving the conditioner about the axis.

21. A method for conditioning a chemical-mechanical polishing pad using a conditioner, the method comprising the steps of:

(a) identifying at least a first region of the polishing pad that requires a greater groove volume per unit area than a second region of the polishing pad;

(b) providing the conditioner with a non-uniform conditioning surface having a first section with a first cutting volume per unit width positioned to contact the first region of the polishing pad and a second section with a second cutting volume per unit width positioned to contact the second region of the polishing pad, the first cutting volume per unit width being greater than the second cutting volume per unit width; and (c) conditioning the polishing pad with the conditioner.

22. A chemical-mechanical polishing pad produced by the conditioning method of claim 21.

23. The method of claim 21 further comprising in step (a) identifying a third region between the first and second regions that requires a groove volume per unit area intermediate the first and second regions; and in step (b) providing the non-uniform conditioning surface of the conditioner with a third section having a third cutting volume per unit width positioned to contact the third region of the polishing pad, the third cutting volume per unit width being intermediate the first and second cutting volumes per unit width.

24. A linear chemical-mechanical polishing (CMP) pad for polishing an object, the polishing pad comprising a non-uniform polishing surface having a plurality of grooves and at least a first region a second region and a third transition region, the first region including a first groove volume per unit area that is different from a second groove volume per unit area of the second region, the first region and second region positioned relative to one another in a configuration capable of providing non-uniform polishing rates for different portions of the object, the third transition region between the first region and the second region comprising a third groove volume per unit area intermediate the first groove volume per unit area and the second groove volume per unit area.

25. The chemical-mechanical polishing pad of claim 24 wherein the first region comprises at least a first groove having a first width and the second region comprises at least a second groove having a second width that is different from the first width.

26. A The chemical-mechanical polishing pad of claim 24 wherein the first region comprises a first groove density and the second region comprises a second groove density different from the first groove density.

27. The chemical-mechanical polishing pad of claim 24 wherein the first region comprises at least a first groove having a first depth and the second region comprises at least a second groove having a second depth that is different from the first depth.

28. The chemical-mechanical polishing pad of claim 24 wherein the first region comprises a center region of the polishing pad and the second region comprises an edge region of the polishing pad.

29. The chemical-mechanical polishing pad of claim 24 wherein the third region comprises a gradual transition in groove volume per unit area between the first groove volume per unit area and the second groove volume per unit area.

30. A The chemical-mechanical polishing pad of claim 24 wherein the non-uniformity in the pad compensates for a non-uniformity in polishing pad wear or a non-uniformity in applied pressure of the polishing pad against a wafer during polishing.

31. A chemical-mechanical polishing tool comprising:

a polishing pad, a conditioner including a non-uniform conditioning surface with a first section having a first cutting volume per unit width, a second section having a second cutting volume per unit width that is unequal to the first cutting volume per unit width, and a third, transition section between the first section and the second section comprising a third cutting volume per unit width intermediate the first cutting volume per unit width and second cutting volume per unit width; and means for moving the polishing pad relative to the conditioner.

* * * * *